United States Patent [19]

Wilson

[11] Patent Number: 4,744,189

[45] Date of Patent: May 17, 1988

[54] REMOVABLE WALL PANEL

[75] Inventor: William J. Wilson, Pasadena, Md.

[73] Assignee: Snap-Wall, Inc., Baltimore, Md.

[21] Appl. No.: 896,271

[22] Filed: Aug. 14, 1986

[51] Int. Cl.[4] ..... E04C 1/40

[52] U.S. Cl. ..... 52/511; 52/202; 434/421; 434/430; 40/908

[58] Field of Search ..... 52/202, 506, 511, DIG. 13, 52/144; 40/908, 605, 611; 434/430, 416, 421

[56] References Cited

U.S. PATENT DOCUMENTS

| | | | |
|---|---|---|---|
| 2,141,700 | 12/1938 | Tinnerman | 52/511 |
| 2,262,426 | 11/1941 | Hall | 52/511 |
| 2,714,546 | 8/1955 | Lesniak | 52/202 |
| 2,914,873 | 12/1959 | Brennan | 434/430 X |
| 3,038,571 | 6/1962 | Clements | 434/421 X |
| 3,716,935 | 2/1973 | Friederichs | 434/30 X |
| 3,856,611 | 12/1979 | Markley | 52/511 X |
| 3,863,412 | 2/1975 | Bodycomb et al. | 52/DIG. 13 |
| 3,918,187 | 11/1975 | Vogele | 40/611 X |
| 3,965,599 | 6/1976 | Ebner | 40/611 X |
| 4,068,428 | 1/1978 | Peterson, III | 52/202 |
| 4,118,903 | 10/1978 | Coulthard | 52/DIG. 13 |
| 4,462,193 | 7/1984 | Ericson | 52/DIG. 13 |
| 4,562,675 | 1/1986 | Baigas, Jr. et al. | 52/202 |
| 4,581,865 | 4/1986 | Miller | 52/202 |
| 4,635,418 | 1/1987 | Hobgood | 52/DIG. 13 |
| 4,642,926 | 2/1987 | Friedman | 40/605 |

*Primary Examiner*—David A. Scherbel
*Assistant Examiner*—Creighton Smith
*Attorney, Agent, or Firm*—Leonard Bloom

[57] ABSTRACT

A decorative wall panel includes a fabric covering on a board removably secured to an existing wall. The rear of the board carries a plurality of "VELCRO" fasteners for cooperation with corresponding fasteners on the wall. The panels may be easily secured to the wall, such as a drywall partition, and may be just as easily removed whenever desired.

9 Claims, 2 Drawing Sheets

REMOVABLE WALL PANEL

FIELD OF THE INVENTION

The present invention relates to a removable wall panel, and more particularly, to a decorative panel which may be easily and conveniently installed onto existing walls by a simple pushing action, and may be just as easily and conveniently removed from the wall by a simple pulling action, whenever desired, and installed on walls in other locations.

BACKGROUND OF THE INVENTION

Various types of wall coverings for homes, offices, hotels and other installations have been developed in the prior art. These wall coverings may consist of wallpaper, fabric, wood panels, tiles, mirrors, paints, coatings and the like. The appearance, durability and cost of these coverings are paramount criteria. The cost involves the initial installation as well as the maintenance and eventual replacement.

Fabrics are often used to create a "rich" look and to reduce noise, especially where the walls are of the "drywall" type and consist of panels secured to studs to form internal partitions within a building structure. The fabrics may be glued to the drywall partitions; and contrasting colors, patterns and textures may be employed to provide the decorator with a desired effect. The initial installation of fabric wall coverings is relatively expensive; and as a result, their use has been confined to selected installations usually consisting of executive offices. Moreover, once installed the fabric wall coverings are not easily removable; and if removal is ever desired, the fabric coverings must be scraped off and the walls must be sanded. This, too, is expensive and inconvenient.

Since many offices are leased on a short-term basis, say one to three years, the tenants are naturally reluctant to make a relatively-large initial investment in fabric wall coverings, especially since the coverings are a permanent installation. The same situation prevails with respect to tenants in apartments or condos, since these tenants tend to have a transient status.

As a result, there is a long-felt need for a fabric wall covering that may be easily installed and may be just as easily removed, yet provides a designer "look", reduces noise interference, and is color coordinated with the existing furniture and decor.

SUMMARY OF THE INVENTION

Accordingly, it is an object of the present invention to alleviate the disadvantages and deficiencies of the prior art by providing a decorative wall covering in the form of a removable panel, the outside surface of which is provided with a fabric or other suitable covering.

It is another object of the present invention to provide a wall panel adapted to be quickly, easily and conveniently mounted onto an existing wall, such as a drywall partition, and just as quickly, easily and conveniently removed therefrom.

It is yet another object of the present invention to greatly expand the existing market for fabric wall coverings; since once the initial investment is made, the fabric wall coverings may be quickly removed by the tenant and easily reinstalled in a new office, apartment or condominium.

It is, again, another object of the present invention to provide removable wall panels for homeowners, so that rooms may be conveniently switched or redesigned.

It is a further object of the present invention to provide a decorative wall panel, having a fabric or other covering, which may be quickly removed without appreciable damage to the existing wall.

It is a still further object of the present invention to provide a wall panel, having a fabric covering, which may be arranged in a decorative manner to achieve a designer look with adjacent wall panels of the same or of conventional design.

It is a yet still further object of the present invention to provide a removable wall panel having a fabric covering on an acoustical, tackable board, thereby reducing noise.

In accordance with foregoing objects of the present invention and the teachings thereof, there is herein illustrated and described a preferred embodiment of a wall panel adapted to be easily installed onto an existing wall by a simple pushing action and just as easily removed by a simple pulling action away from the wall. The wall panel includes a generally rectangular board having four respective corners and further having front and rear surfaces and respective side and end edges joining at respective corners of the board, thereby forming a core to provide structural rigidity. A covering is provided for the front surface of the board and has respective portions wrapped around the side and end edges thereof and further being secured to the rear surface of the board. A plurality of quick-disconnect fibrous fasteners is associated with the rear surface of the board; these fasteners are arranged substantially inwardly adjacent to the respective wrapped-around portions of the covering at the respective corners of the board. Each of the quick-disconnect fibrous fasteners includes first and second sections. The respective first sections are secured to the rear surface of the board, and the respective second sections are secured to the wall in substantial alignment with the respective first sections on the board. With this arrangement, when the respective first and second sections of the quick-disconnect fibrous fasteners are in meshing engagement, the panels are secured to the wall, yet may be removed therefrom by manually pulling the panels away from the wall, such that the respective first and second sections of the plurality of quick-disconnect fibrous fasteners are disengaged.

Preferably, the covering is a fabric, and the board is an acoustical, tackable board. Moreover, a further quick-disconnect fibrous fastener is located substantially at the geometric center at the rear surface of the board so as to provide additional support for the removable wall panel.

Preferably, the quick-disconnect fibrous fasteners are "VELCRO" fasteners, which are readily available.

In accordance with the still further teachings of the present invention, there is herein illustrated and described in conjunction with a building structure, the combination of a plurality of vertical studs, a drywall partition secured to the studs, and a wall panel removably secured to the partition. The wall panel is preferably an acoustical tackable board having a front surface, a rear surface and respective peripheral edges. The board further has a rectangular plan outline provided with four corners. A fabric covering is stretched substantially taut over the front surface of the board and is wrapped around the peripheral edges thereof. At least four fastener means are provided, one each substantially adjacent to a respective corner of the board and spaced inwardly of the respective wrapped around portions of the fabric covering. Each fastener includes respective first and second sections. The first section is secured to the drywall partition, and the second section is secured to the rear surface of the board in substantial alignment with the first section. As a result, the drywall partition and the rear surface of the board have an air space therebetween. With this arrangement, the wall panel may be easily and conveniently installed on the drywall partition and, whenever desired, easily and conveniently removed therefrom.

These and other objects of the present invention will become apparent from a reading of the following specification, taken in conjunction with the enclosed drawings.

GENERAL DESCRIPTION OF THE PREFERRED EMBODIMENT

Figure 1:
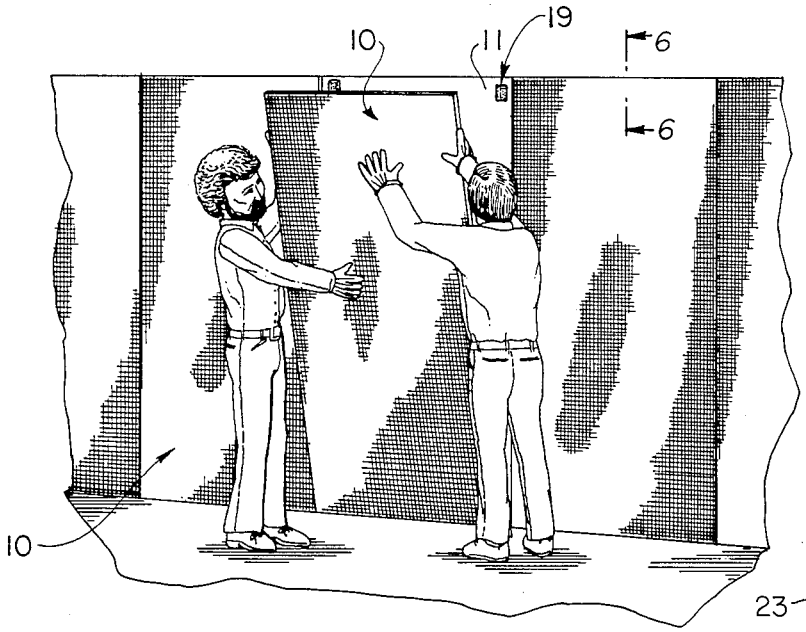
FIG. 1 illustrates the manner in which the wall panels of the present invention may be easily and conveniently installed on an existing wall, such as a drywall partition.
Figure 2:
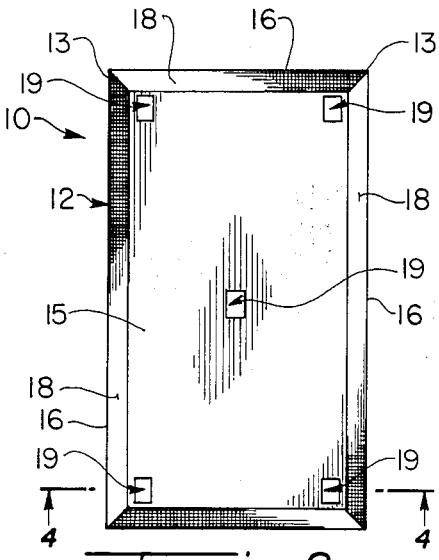
FIG. 2 is a rear elevational view of one of the wall panels of the present invention, showing the wrapped-around portions of the fabric covering, and further showing four "VELCRO" fasteners substantially adjacent to the respective corner of the panel.
Figure 3:
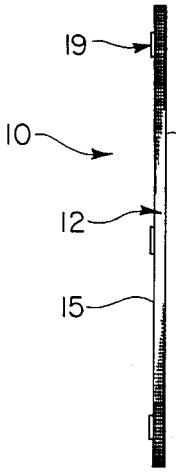
FIG. 3 is a side elevational view of the wall panel of FIG. 2.

With reference to FIGS. 1–5, a plurality of wall panels 10 is adapted to be removably secured to an existing wall 11, as shown more clearly in FIG. 1. The panels 10 are arranged vertically in side-by-side relationship. Suitable headers or baseboards (not shown) may be employed, if desired. Preferably, each panel is substantially rectangular, although other shapes and plan outlines are equally feasible consonant with the teachings of the present invention.

Each wall panel 10 includes a board 12 providing a core for structural rigidity or integrity of the panel. Preferably, the board 12 is a tackable, acoustical board. As shown more clearly in FIG. 2, the board 12 has a generally rectangular plan outline having respective corners 13. Moreover, the board includes a front surface 14, a rear surface 15, and peripheral edges 16. Since four foot boards are readily available, the panels are $4\times8'$, $4\times10'$ or $4\times12'$, and may be cut to any desired size below twelve feet. However, any size panel is feasible, consonant with the teachings of the present invention.

A fabric 17 is stretched substantially taut over the front surface of the board, is wrapped around the peripheral edges of the board, and is suitably secured (by stapling or the like, not shown) to the rear surface of the board. The wrapped-around portions 18 of the fabric are shown more clearly in FIG. 2.

A plurality of "VELCRO" quick-disconnect fibrous fasteners 19 is used to removably secure the respective wall panels to the existing wall. Preferably, a "VELCRO" fastener is located substantially adjacent to the respective four corners of the board, inwardly of the wrapped-around portions of the fabric; and for relatively small panels, a fifth "VELCRO" fastener 19 is located at the approximate geometrical center of the board at the rear surface thereof. Each "VELCRO" fastener 19 includes a first section 20 secured to the wall, and further includes a second section 21 secured to the rear surface of the board. These first and second sections of the respective "VELCRO" fasteners are pre-arranged in substantial alignment with each other. The "VELCRO" fasteners may have suitable protective layers, one of which is shown at 22 in FIG. 5. When the protective layer is peeled away, the adhesive surface is exposed.

With panels ranging in size from $4\times8'$ to $4\times12'$, it has been found more desirable to provide a "VELCRO" (or other suitable) fastener on two foot centers in addition to the four corners.

Figure 6:
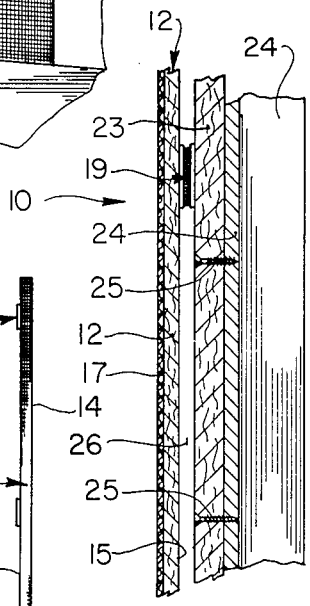
FIG. 6 is a still further cross-sectional view, taken along the lines 6—6 of FIG. 1 and drawn to an enlarged scale, and showing the wall panel removably secured to an existing drywall partition.
Figure 4:
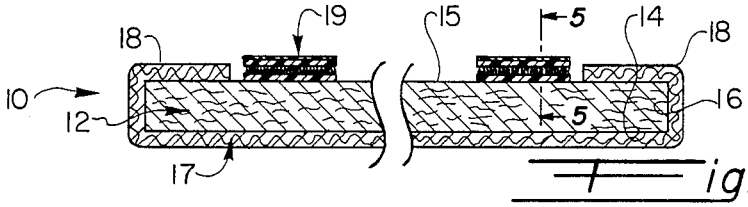
FIG. 4 is a cross-sectional view, taken along the lines 4—4 of FIG. 2 and drawn to an enlarged scale, showing the fabric covering on the acoustical tackable board (the latter forming a core providing structural rigidity for the removable wall panel), and further showing two of the "VELCRO" fasteners.
Figure 5:
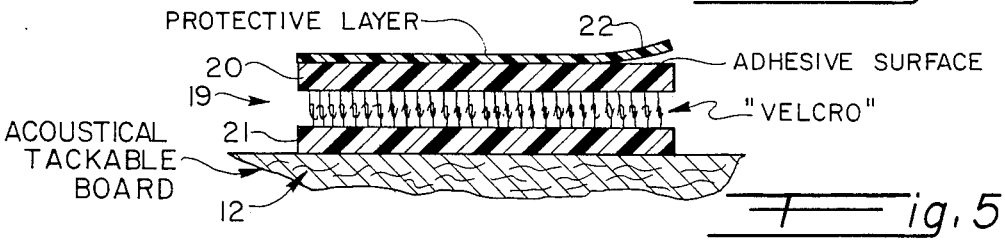
FIG. 5 is a further cross-sectional view, taken along the lines 5—5 of FIG. 4 and drawn to an enlarged scale, and showing the respective first and second sections of one of the "VELCRO" fasteners.

With reference to FIG. 6, the wall 11 may comprise a "drywall" partition 23 secured to a channel-formed stud 24 by self-tapping screws 25, and the wall panel 10 is removably secured to the wall by the "VELCRO" fasteners, such that an air space 26 is present between the wall and the wall panel.

Figure 7:
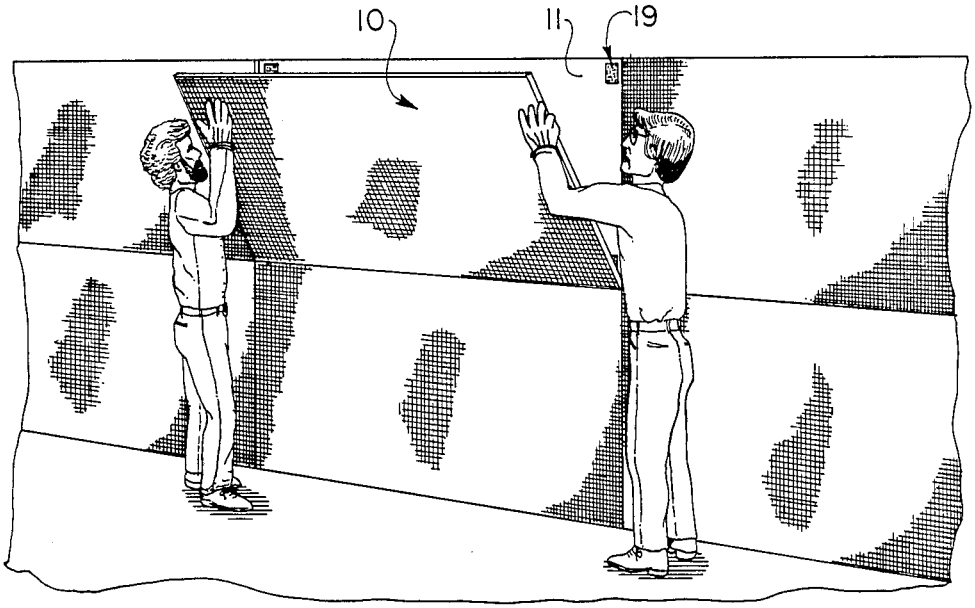
FIG. 7 corresponds substantially to FIG. 1, but illustrates how the wall panels of present invention may be installed horizontally instead of vertically.

With reference to FIG. 7, the wall panels 10 are arranged horizontally, instead of vertically as shown in FIG. 1.

Figure 8:
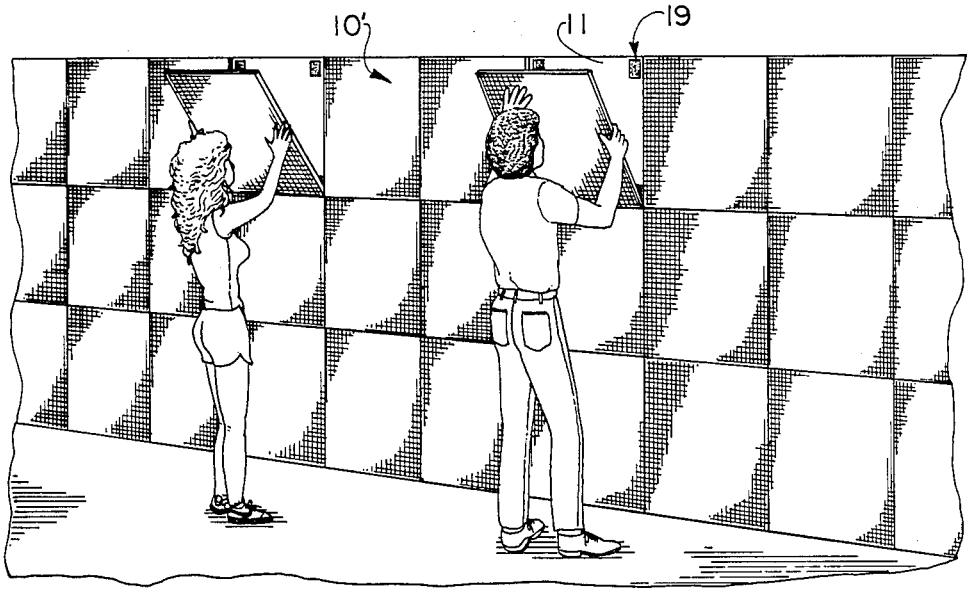
FIG. 8 illustrates how the teachings of the present invention are equally applicable to smaller panels.

With reference to FIG. 8, wall panels 10' are substantially smaller and, preferably, are formed as squares.

The wall panels 10 (or 10') may be removably applied to any existing wall, such as the drywall partition shown in FIG. 6; or to a concrete block or cinder block wall, or to existing wood paneling; or to walls covered with paper or paint; or may be combined with, or interspersed with, more conventional paneling, coverings or coatings to provide an effect desired by an interior decorator. No special preparation to the existing wall is necessary, and this is yet another advantage of the present invention. With the fabric covering on the acoustical-quality boards, the panels have a sound-deadening feature to facilitate comfort and privacy. When the panels of the present invention are removed from the wall, only one of the sections of the conventional "VELCRO" fastener remains; and thus damage to the existing wall is held to a minimum, and repairs thereto are relatively easy.

Obviously, any modifications may be made without departing from the basic spirit of the present invention. Accordingly, it will be appreciated by those skilled in the art that within the scope of the appended claims, the invention may be practiced other than has been specifically described herein.

I claim:

1. In combination with an existing wall in a home or office, wherein the existing wall comprises an uninterrupted structural surface, a totally reusable decorative wall panel consisting of a covering adapted to be easily installed on to said existing wall by a simple pushing action and just as easily removed by a simple pulling action away from the wall, said panel comprising a generally rectangular board having four respective corners and further having front and rear surfaces and respective side and end edges joining at respective corners of the board, thereby forming a core to provide structural rigidity, the board comprising an acoustical board, thereby providing noise reduction in the home or office, the board further being tackable, thereby accommodating the posting of notes or other papers thereon, a fabric for the front surface of the board and having respective portions wrapped around and contacting all of the side and end edges thereof and further being secured to the rear surface of the board, a plurality of quick-disconnect fibrous fasteners associated with the rear surface of the board and arranged thereon substantially inwardly adjacent to the respective wrapped-around portions of the fabric at the respective corners of the board, each of the quick-disconnect fibrous fasteners having a depth and each fastener comprising first and second sections, the respective first sections being secured to the rear surface of the board, and the respective second sections being secured to the wall in substantial alignment with the respective first sections on the board, such that when the respective first and second sections of the quick-disconnect fibrous fasteners are in meshing engagement, the panels are secured in place being spaced from the wall, but may be removed therefrom by manually pulling the panels away from the wall such that the respective first and second sections of the plurality of quick-disconnect fibrous fasteners are disengaged, whereby the panel is easy to install or to remove, so that a succession of panels may be installed adjacent to each other to provide a substantially total covering for the existing wall, and whereby the panel is totally reusable in other homes or offices as a covering for an existing wall therein.

2. The wall panel of claim 1, further including a quick-disconnect fibrous fastener located substantially at the geometric center at the rear surface of the board.

3. In combination with an existing wall in a home or office, wherein the existing wall comprises an uninterrupted structural surface, a totally reusable decorative wall panel consisting of a covering adapted to be easily installed on to said existing wall by a simple pushing action and just as easily removed by a simple pulling action away from the wall, said panel comprising a generally rectangular acoustical, tackable board, wherein the board reduces noise in the home or office, and wherein notes or other papers may be posted on the tackable board, the board having four respective corners and further having front and rear surfaces and respective side and end edges joining at respective corners of the board, thereby forming a core to provide structural rigidity, a fabric covering for the front surface of the board and having respective portions wrapped around and contacting all of the side and end edges thereof and further being secured to the rear surface of the board, a plurality of quick-disconnected fibrous fasteners associated with the rear surface of the board and including fasteners arranged thereon substantially inwardly adjacent to the respective wrapped-around portions of the fabric covering at the respective corners of the board, and further including at least one fastener located substantially at the geometric center of the board at the rear surface thereof, each of the quick-disconnect fibrous fasteners having a depth and each fastener comprising first and second sections, the respective first sections being secured to the rear surface of the board, and the respective second sections being secured to the wall in substantial alignment with the respective first sections on the board, such that when the respective first and second sections of the quick-disconnect fibrous fasteners are in meshing engagement, the panels are secured in place being spaced from the wall, but may be removed therefrom by manually pulling the panels away from the wall such that the respective first and second sections of the plurality of quick-disconnect fibrous fasteners are disengaged, whereby the panel is easy to install or to remove, so that a succession of panels may be installed adjacent to each other to provide a substantially total covering for the existing wall, and whereby the panel is totally reusable in other homes or offices as a covering for an existing wall therein.

4. In combination with a building structure in a home or office, the structure including a plurality of vertical studs and a drywall partition secured to the studs, thereby forming an existing uninterrupted structural surface, a completely reusable decorative wall panel consisting of a covering for the existing uninterrupted structural surface and including a board having a first surface, a rear surface, and respective peripheral edges providing structural rigidity for the panel, tne board further including a fabric covering for the front surface of the board, said fabric covering being wrapped around and contacting all the peripheral edges of the board and further being secured to the rear surface of the board, wherein the board comprises an acoustical board, thereby reducing noise in the home or office, and wherein the board is tackable, such that notes or other papers may be removably attached to the board, and a plurality of fasteners between the rear surface of the board and the drywall partition, each fastener including respective first and second sections, the first section being secured to the drywall partition, and the second section being secured to the rear surface of the board in substantial alignment with the first section, and the drywall partition and the rear surface of the board having an air space therebetween, whereby the panel is easy to install or to remove, so that a succession of panels may be installed adjacent to each other to provide a substantially total covering for the uninterrupted structural surface, and whereby the panel is totally reusable in other homes or offices as a covering for an existing wall therein.

5. The combination of claim 4, wherein the board has a rectangular plan outline provided with four corners, and wherein a plurality of four fasteners are provided, one each spaced substantially adjacent to a respective corner of the board.

6. The combination of claim 5, further including a fifth fastener located substantially at the geometric center at the rear surface of the board.

7. The combination of claim 5, further including a second plurality of fasteners located on approximately two foot centers on the rear surface of the board.

8. The combination of claim 4, wherein the covering comprises a fabric stretched substantially taut over the front surface of the board and wrapped around the peripheral edges thereof.

9. In combination with a building structure in a home or office, the combination including a plurality of vertical studs and a drywall partition secured to the studs therby forming an existing uninterrupted structural surface, a completely reusable decorative wall panel consisting of a covering for the existing uninterrupted structural surface and including an acoustical tackable board having a front surface, a rear surface and respective peripheral edges, wherein the board reduces noise in the home or office, and wherein notes or other papers may be removably attached to the board, the board further having a rectangular plan outline provided with four corners, a fabric covering stretched substantially taut over the front surface of the board and wrapped around and contacting all of the peripheral edges thereof and secured to the rear surface of the board, a plurality of at least four quick-disconnect fibrous fasteners, one each substantially adjacent to a respective corner of the board and spaced inwardly of the respective wrapped around portions of the fabric covering, each fastener including respective first and second sections, the first section being secured to the drywall partition, and the second section being secured to the rear surface of the board in substantial alignment with the first section, and the drywall partition and the rear surface of the board having an air space therebetween, whereby the wall panel may be easily and conveniently installed on the drywall partition and, whenever desired, easily and conveniently removed therefrom, so that a succession of panels may be installed adjacent to each other to provide a substantially total covering for the uninterrupted structural surface, and wherein the panel may be reused in another home or office as a covering for an existing wall therein.

* * * * *